US010479553B2

(12) United States Patent
Guerry et al.

(10) Patent No.: US 10,479,553 B2
(45) Date of Patent: Nov. 19, 2019

(54) NESTABLE PALLET

(71) Applicant: Rehrig Pacific Company, Los Angeles, CA (US)

(72) Inventors: Brian Robert Guerry, Costa Mesa, CA (US); Travis James Englert, Brea, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 15/441,419

(22) Filed: Feb. 24, 2017

(65) Prior Publication Data

US 2017/0297765 A1 Oct. 19, 2017

Related U.S. Application Data

(60) Provisional application No. 62/300,402, filed on Feb. 26, 2016.

(51) Int. Cl.

| | |
|---|---|
| ***B65D 19/38*** | (2006.01) |
| ***B65D 19/04*** | (2006.01) |
| ***B65D 19/00*** | (2006.01) |

(52) U.S. Cl.

CPC ..... *B65D 19/385* (2013.01); *B65D 19/0018* (2013.01); *B65D 19/04* (2013.01); *B65D 19/38* (2013.01); *B65D 2519/00034* (2013.01); *B65D 2519/00069* (2013.01); *B65D 2519/0094* (2013.01); *B65D 2519/00189* (2013.01); *B65D 2519/00268* (2013.01); *B65D 2519/00308* (2013.01); *B65D 2519/00338* (2013.01); *B65D 2519/00407* (2013.01); *B65D 2519/00746* (2013.01); *B65D 2519/00771* (2013.01); *B65D 2519/00776* (2013.01); *B65D 2519/00791* (2013.01)

(58) Field of Classification Search

CPC ..... B65D 19/385; B65D 19/38; B65D 19/04

See application file for complete search history.

(56) References Cited

U.S. PATENT DOCUMENTS

| | | | |
|---|---|---|---|
| 2,544,657 | A | 3/1951 | Cushman |
| 2,916,239 | A | 12/1959 | Stopps |

(Continued)

FOREIGN PATENT DOCUMENTS

| | | | |
|---|---|---|---|
| DE | 2232200 | A1 | 1/1973 |
| DE | 2613083 | A1 | 10/1977 |

(Continued)

*Primary Examiner* — Daniel J Rohrhoff

(74) *Attorney, Agent, or Firm* — Carlson, Gaskey & Olds, P.C.

(57) ABSTRACT

A nestable pallet includes a deck having opposed side edges and opposed end edges. A plurality of feet extend downward from the deck. The feet are hollow and elongated in a direction parallel to the side edges of the deck. The deck includes openings therethrough that lead into the feet for receiving the feet of an identical nestable pallet nested thereon. A half pallet includes a half deck and a plurality of feet extending downward from the half deck. The feet of the half pallet extend into half of the plurality of feet of the nestable pallet. Optionally, the deck further includes a handle opening having at least one handle wall adjacent the handle opening. A plurality of ribs extend upward from the handle wall.

26 Claims, 12 Drawing Sheets

(56) References Cited

U.S. PATENT DOCUMENTS 3,298,327 A * 1/1967 Grimes ..... B65D 19/38 108/57.1
3,424,110 A 1/1969 Toot
3,526,195 A 9/1970 Maryonovich
3,640,229 A 2/1972 Bell
3,685,461 A 8/1972 Belcher
3,685,463 A 8/1972 Francis
D225,397 S 12/1972 Lindley
3,709,162 A 1/1973 Roper
4,013,021 A 3/1977 Steinlein et al.
4,133,270 A 1/1979 Ravera
D258,948 S 4/1981 Stump, Jr.
4,263,855 A 4/1981 Lawlor
4,428,306 A 1/1984 Dresen et al.
4,879,956 A 11/1989 Shuert
5,046,434 A 9/1991 Breezer et al.
5,088,418 A 2/1992 Reckermann et al.
5,117,762 A 6/1992 Shuert
5,168,817 A 12/1992 Nulle et al.
5,483,899 A * 1/1996 Christie ..... B65D 19/0073 108/56.3
5,527,585 A 6/1996 Needham et al.
5,566,624 A 10/1996 Brown et al.
5,586,666 A * 12/1996 Squitieri ..... A47F 5/10 108/54.1
5,606,921 A 3/1997 Elder et al.
5,638,760 A 6/1997 Jordan et al.
5,664,934 A 9/1997 Schaede et al.
D388,931 S 1/1998 Constantino et al.
5,755,162 A 5/1998 Knight et al.
5,769,001 A 6/1998 Viessmann
5,769,003 A 6/1998 Rose et al.
5,791,262 A 8/1998 Knight et al.
5,813,355 A 9/1998 Brown et al.
D400,682 S 11/1998 Constantino et al.
5,857,416 A 1/1999 Donnell, Jr. et al.
5,950,545 A 9/1999 Shuert
5,964,162 A 10/1999 Chuan-Jen
5,996,508 A 12/1999 Constantino et al.
6,029,583 A * 2/2000 LeTrudet ..... B65D 19/0012 108/57.25
6,289,823 B1 9/2001 Koefelda et al.
6,294,114 B1 9/2001 Muirhead
6,327,984 B1 12/2001 McCann et al.
6,718,888 B2 4/2004 Muirhead
D513,104 S 12/2005 Harding et al.
6,997,113 B1 2/2006 Harding et al.
7,360,493 B2 4/2008 Hummel et al.
7,690,315 B2 4/2010 Apps
7,779,764 B2 * 8/2010 Naidu ..... B65D 19/0095 108/56.1
7,819,068 B2 * 10/2010 Apps ..... B65D 19/004 108/53.1
7,987,797 B2 * 8/2011 Stahl ..... B65D 19/004 108/53.3
8,191,486 B2 6/2012 Apps et al.
8,196,527 B2 6/2012 Linares
8,230,793 B2 7/2012 Apps
8,448,583 B2 5/2013 Apps et al.
D724,809 S 3/2015 Howland et al.
8,967,056 B2 3/2015 Apps et al.
D729,488 S 5/2015 Pulskamp et al.
9,169,040 B2 10/2015 Evans et al.
D753,392 S 4/2016 Haas et al.
D756,645 S 5/2016 Haas et al.
9,387,953 B2 7/2016 Takyar et al.
9,611,071 B2 4/2017 Baltz et al.
2001/0029874 A1 * 10/2001 Muirhead ..... B65D 19/0012 108/57.25
2002/0017225 A1 2/2002 Koefelda et al.
2004/0134390 A1 7/2004 Apps et al.
2004/0168618 A1 9/2004 Muirhead
2005/0045639 A1 * 3/2005 Thorpe ..... B65D 19/385 220/495.01
2005/0211139 A1 * 9/2005 Perrotta ..... B65D 19/0038 108/57.25
2006/0032411 A1 2/2006 Hummel et al.
2006/0254476 A1 11/2006 MacDonald et al.
2008/0060561 A1 3/2008 Carrasco
2008/0295748 A1 12/2008 Yoshida et al.
2010/0043678 A1 2/2010 Linares
2011/0100268 A1 5/2011 Milkowski et al.
2011/0139040 A1 6/2011 Apps et al.
2012/0291678 A1 11/2012 Howland et al.
2014/0000493 A1 1/2014 Apps et al.
2014/0283713 A1 9/2014 Baltz et al.
2014/0319302 A1 * 10/2014 Baltz ..... B65D 19/385 248/346.02
2015/0068436 A1 * 3/2015 Zelek ..... B65D 19/0018 108/53.3
2015/0108037 A1 4/2015 Evans et al.
2015/0135999 A1 * 5/2015 Takyar ..... B65D 19/0018 108/53.3
2016/0318656 A1 11/2016 Takyar et al.
2016/0318657 A1 11/2016 Takyar et al.
2017/0036810 A1 * 2/2017 Burk ..... B65D 19/38
2017/0081075 A1 * 3/2017 Bruce ..... B65D 19/385

FOREIGN PATENT DOCUMENTS

DE 2733457 2/1979
DE 3806097 9/1989
EP 202203 11/1986
EP 849184 6/1998
EP 2028117 2/2009
EP 2724956 4/2014
FR 1449377 8/1966
FR 2206248 6/1974
FR 2259023 8/1975
FR 2274512 1/1976
FR 2486029 1/1982
GB 859186 1/1961
GB 901340 7/1962
HU 9303243 3/1994
HU 9900326 5/1999
JP 53058581 5/1978
JP 04114859 4/1994
JP 06179448 6/1994
JP 06191536 7/1994
WO WO9411262 5/1994
WO WO2004063035 7/2004
WO WO2005068309 7/2005

* cited by examiner

NESTABLE PALLET

BACKGROUND

Pallets are used to support goods above a floor so that they can be lifted and moved by a pallet jack or fork lift. Some pallets are nestable in that the feet of the pallet can be received through openings in a deck of an identical pallet and partially received in the hollow feet of the lower pallet. This reduces the overall shipping and storage height of the empty pallets.

SUMMARY

A nestable pallet provided herein includes a deck having opposed side edges and opposed end edges. A plurality of feet extend downward from the deck. The feet are hollow and elongated in a direction parallel to the side edges of the deck. The deck includes openings therethrough that lead into the feet for receiving the feet of an identical nestable pallet nested thereon. The feet may be elongated to where the length is at least three times the width. The elongated feet provide stability when the pallet is traveling on a conveyor with rollers, so that the elongated feet are always in contact with more than one roller.

A half pallet includes a half deck and a plurality of feet extending downward from the half deck. The feet of the half pallet extend into a subset (e.g. half or less) of the plurality of feet of the nestable pallet. In this manner, two half pallets can be nested into a single full size pallet. A full size pallet can be nested into the two half pallets as well. This provides a system of pallets of different sizes that are compatible with one another.

Optionally, the deck further includes a handle opening having at least one handle wall adjacent the handle opening. A plurality of ribs extend upward from the handle wall. This provides a smooth continuous surface for the user's hand to contact when the user grabs the handle.

The deck may also include a plurality of slots or connection points about the perimeter thereof for attachment to a display or cover.

DETAILED DESCRIPTION OF A PREFERRED EMBODIMENT

Figure 1:
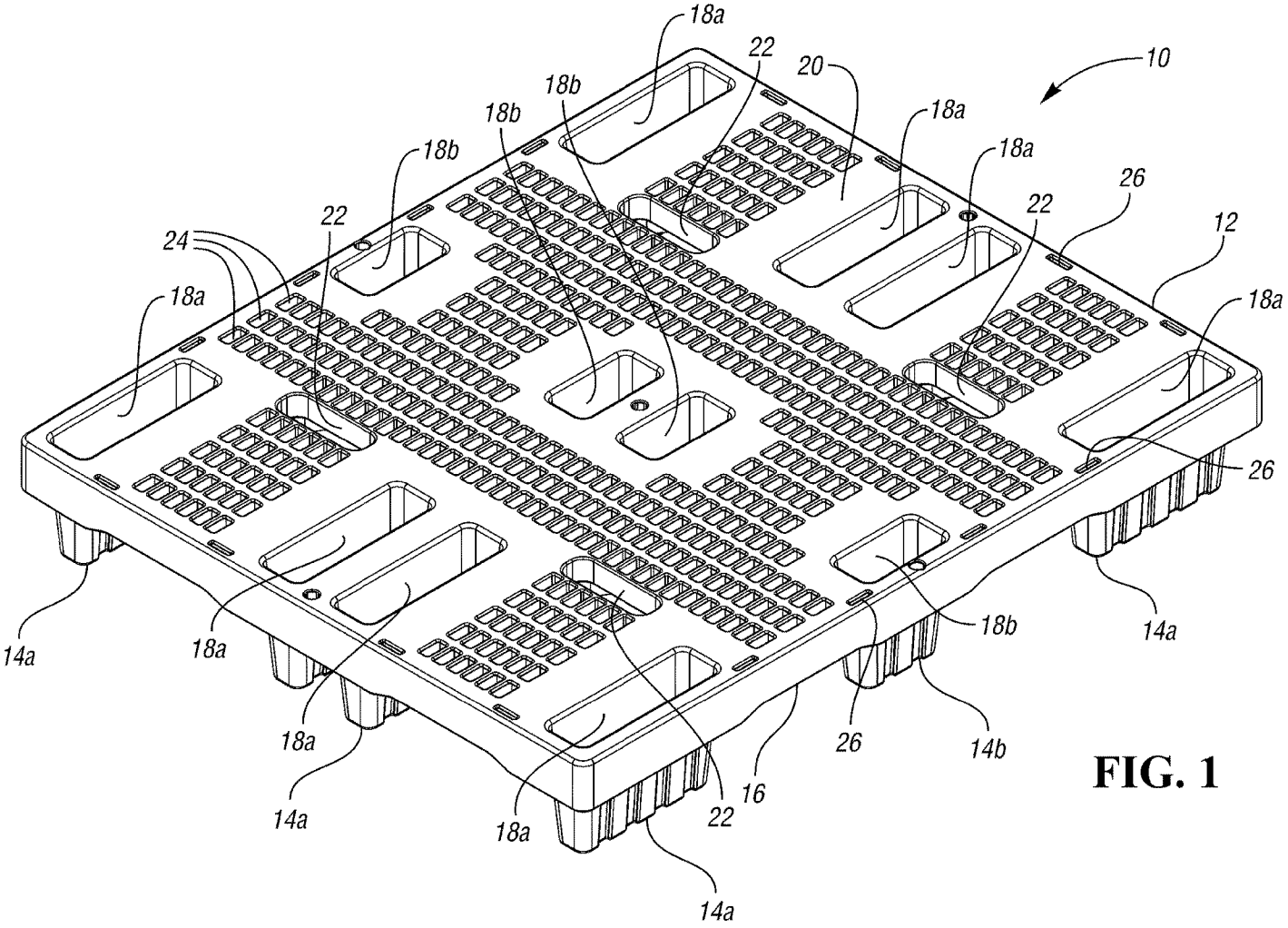
FIG. 1 is a top perspective view of a nestable pallet according to one embodiment.
Figure 2:
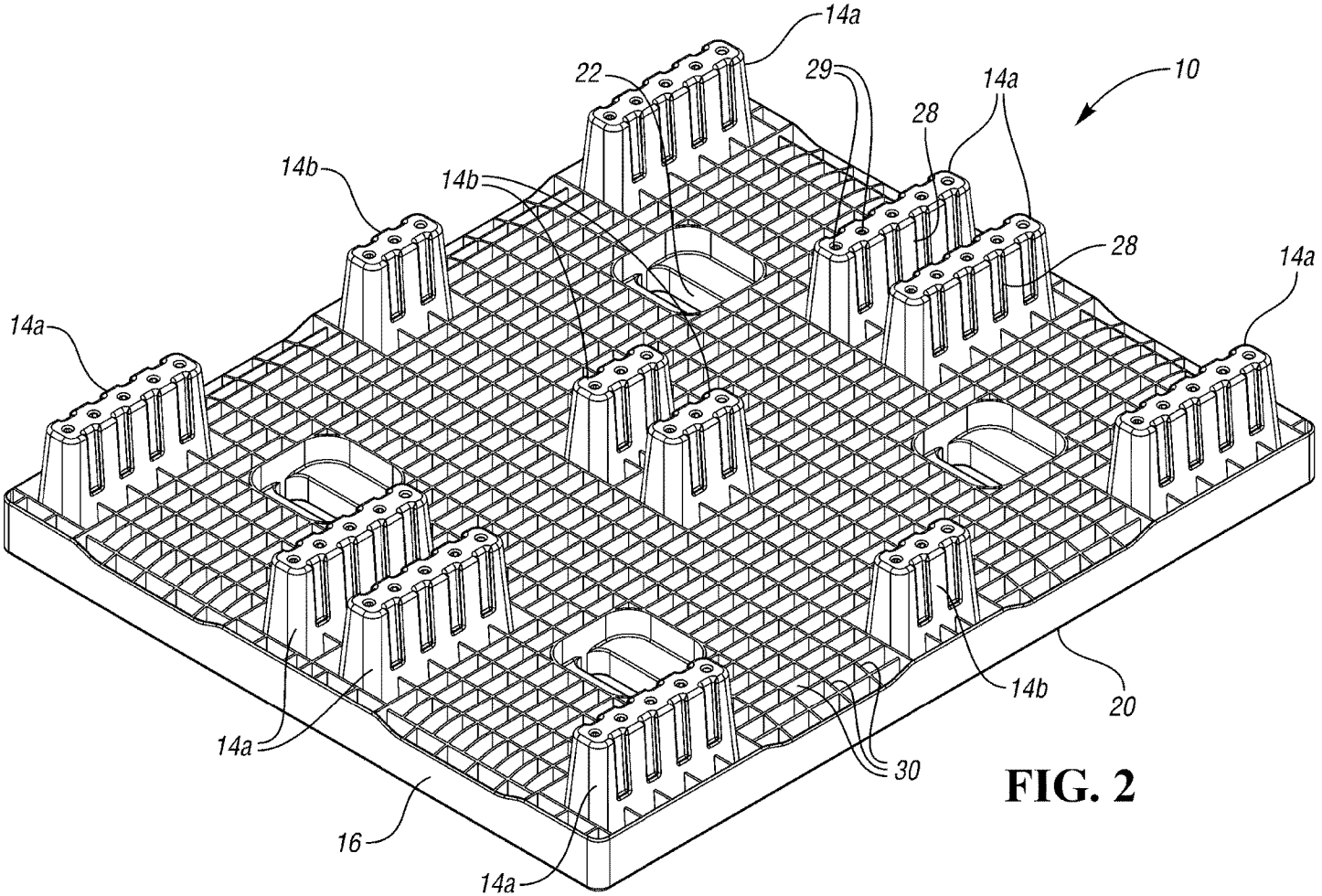
FIG. 2 is a bottom perspective view of the nestable pallet of FIG. 1.

A nestable pallet 10 is shown in FIG. 1. Referring to FIGS. 1 and 2, the pallet 10 includes a deck 12 supported by a plurality of feet 14*a-b* (collectively, feet 14). The pallet 10 includes four outer feet 14*a* at each end of the pallet 10, including one at each corners of the pallet 10 and two in the center of each end of the pallet 10. The pallet 10 further includes four inner feet 14*b*, including one inner foot 14*b* along each side edge of the pallet 10 and a pair of spaced-part inner feet 14*b* at the center of the pallet 10. The outer feet 14*a* are identical to one another, other than location. The inner feet 14*b* have a shorter length than the outer feet 14*a*, but are identical to one another, other than location.

Each of the feet 14 is elongated in a direction generally parallel to the side edges, which are longer than the end edges of the pallet 10. The outer feet 14*a* are at least three and preferably about three to four times longer than they are wide. The inner feet 14*b* are approximately twice as long as wide. The deck 12 includes a lip 16 projecting downward at a periphery of the deck 12. A plurality of openings 18*a-b* (collectively, openings 18) extend through an upper planar sheet 20 of the deck 12 and are aligned with each of the feet 14, which are hollow and tapered downward. The deck 12 includes a plurality of handle openings 22 therethrough. The upper planar sheet 20 of the deck 12 also includes a plurality of smaller openings 24 therethrough, some of which provide drainage through the deck 12. The deck 12 further includes a plurality of openings or slots 26 around the periphery of the deck 12 for connection to a cover or display.

Referring to FIG. 2, each of the feet 14 includes a pair of opposed, corrugated side walls 28 and a bottom wall having drainage openings 29. The deck 12 includes a grid of interconnected ribs 30 projecting downward from the upper planar sheet 20. As shown in FIG. 2, the handle openings 22 are recessed upward from the ribs 30 on the underside of the deck 12.

Figure 3:
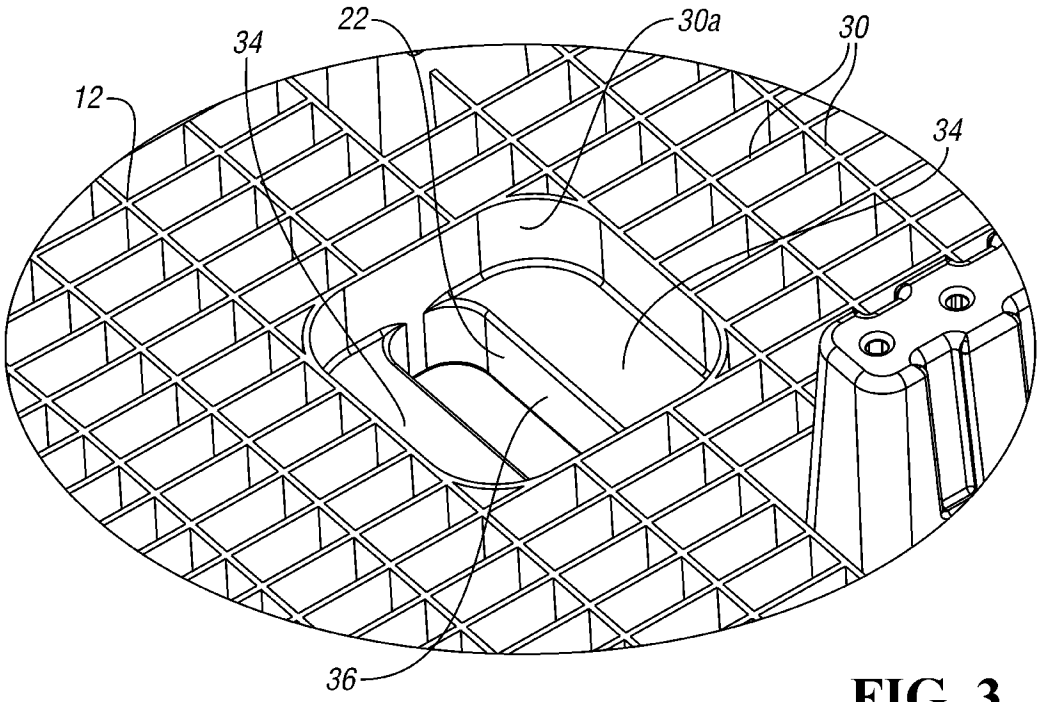
FIG. 3 is an enlarged view of one of the handle areas of the nestable pallet of FIG. 2.

This is shown more clearly in FIG. 3, which is an enlarged view of a portion of FIG. 2. The handle opening 22 extends through the deck 12 but there are substantially horizontal, planar handle walls 34 providing smooth, continuous, lower surfaces adjacent the handle openings 22 on the underside of the deck 12. These handle walls 34 are recessed relative to the ribs 30, including a peripheral rib 30*a* that extends about the periphery of the handle recess in the underside of the deck 12. A side wall 36 extends around the periphery of the handle opening 22 and extends upward from the handle walls 34 to the upper planar sheet 20 (FIG. 1). The recess and smooth surfaces of the handle walls 34 provide a more ergonomic handle for the pallet 10.

Figure 3A:
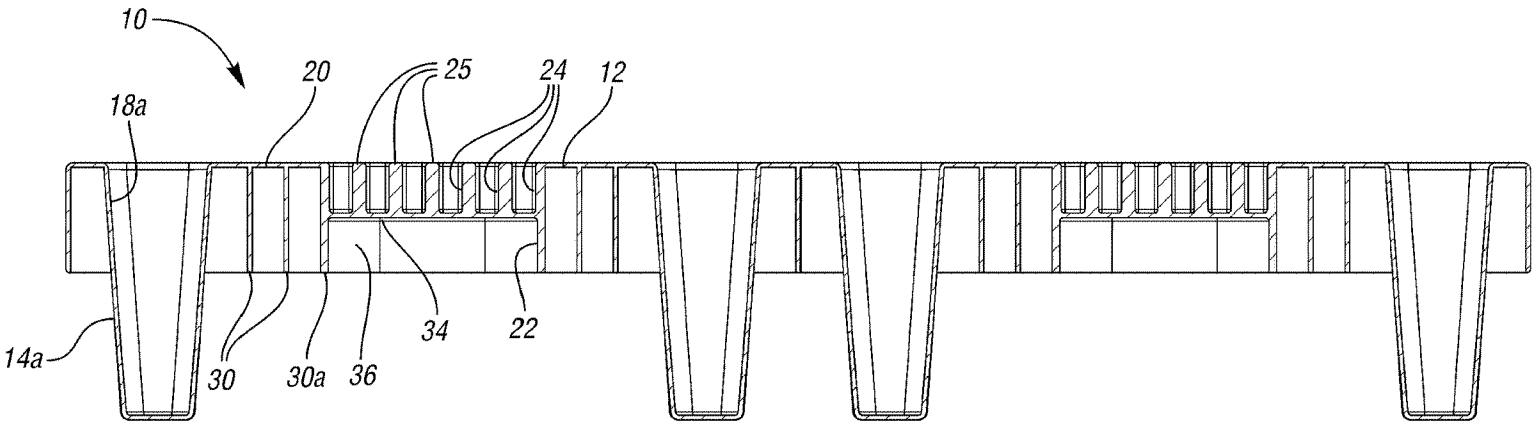
FIG. 3A is a section view taken along line 3A-3A of FIG. 6, adjacent one of the handle openings
Figure 6:
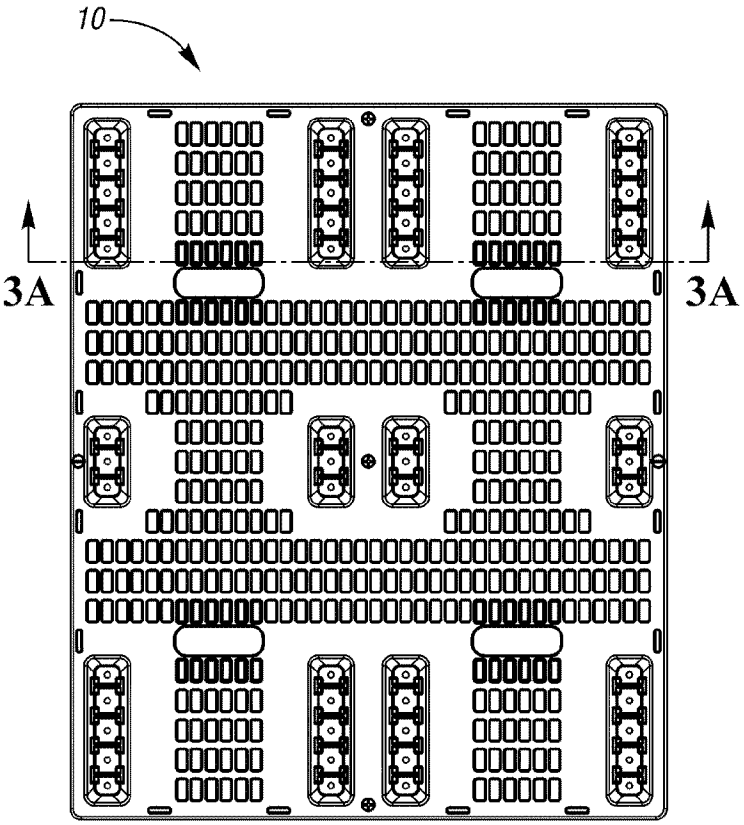
FIG. 6 is a top view of the pallet.

FIG. 3A is a section view taken along line 3A-3A of FIG. 6, adjacent one of the handle openings 22. The handle walls 34 adjacent the handle opening 22 are below some of the openings 24 through the upper planar sheet 20, which are separated by ribs 25 extending upward from the surface 34. Upper edges of the ribs 25 are flush with the upper planar sheet 20. Reinforcement ribs 30 extend downward from the upper planar sheet 20, including peripheral rib 30*a* that extends about the periphery of the handle recess.

Figure 4:
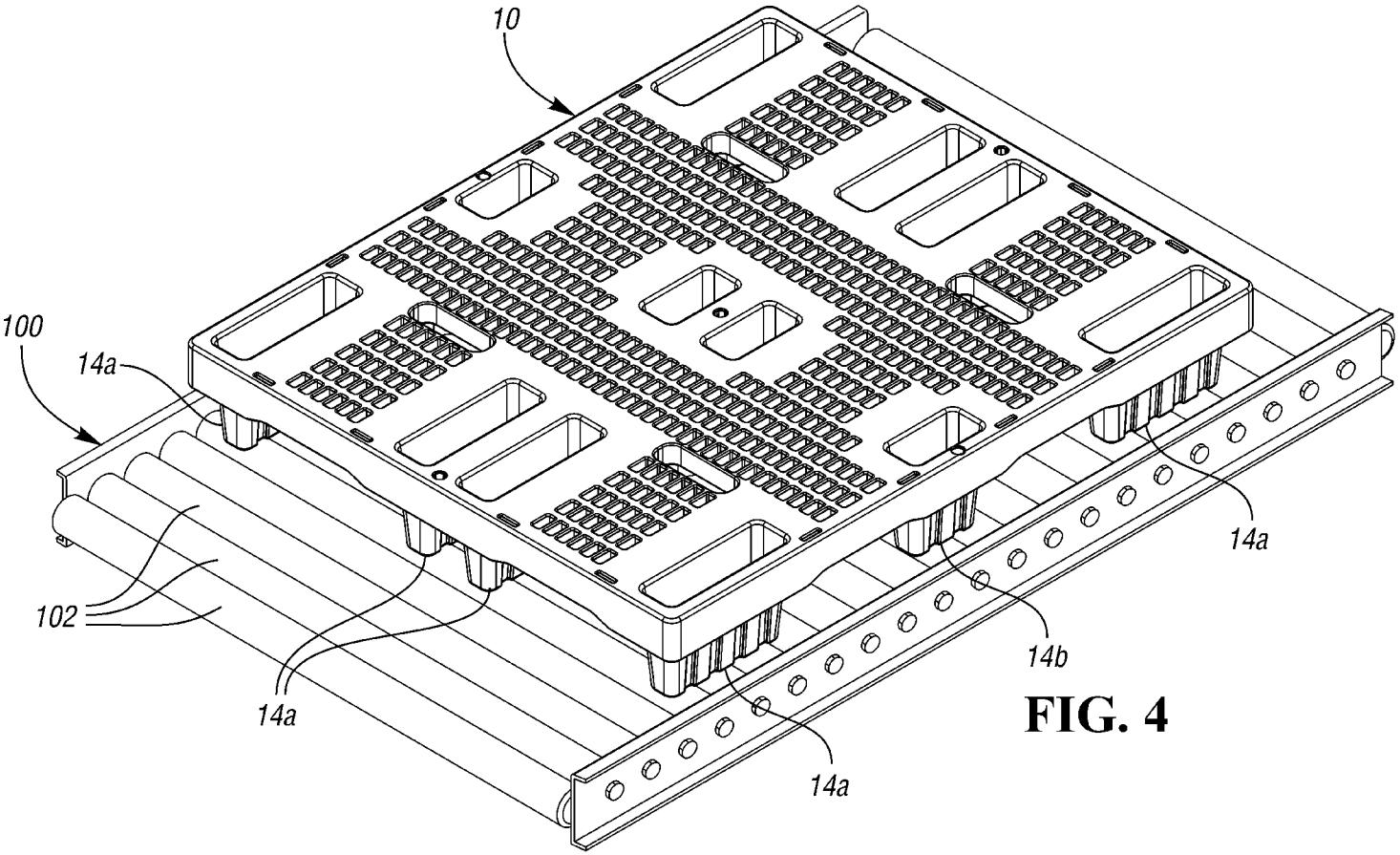
FIG. 4 is a perspective view of the nestable pallet of FIG. 1 on a conveyor of rollers.

As shown in FIG. 4, the elongated feet 14 increase the stability of the pallet 10 on a conveyor 100 having rollers 102. The feet 14 are elongated in a direction perpendicular to the axes of the rollers 102 and parallel to the direction of travel. Each elongated foot 14 will always contact a plurality of rollers 102, thereby increasing stability.

Figures 5, 5A:
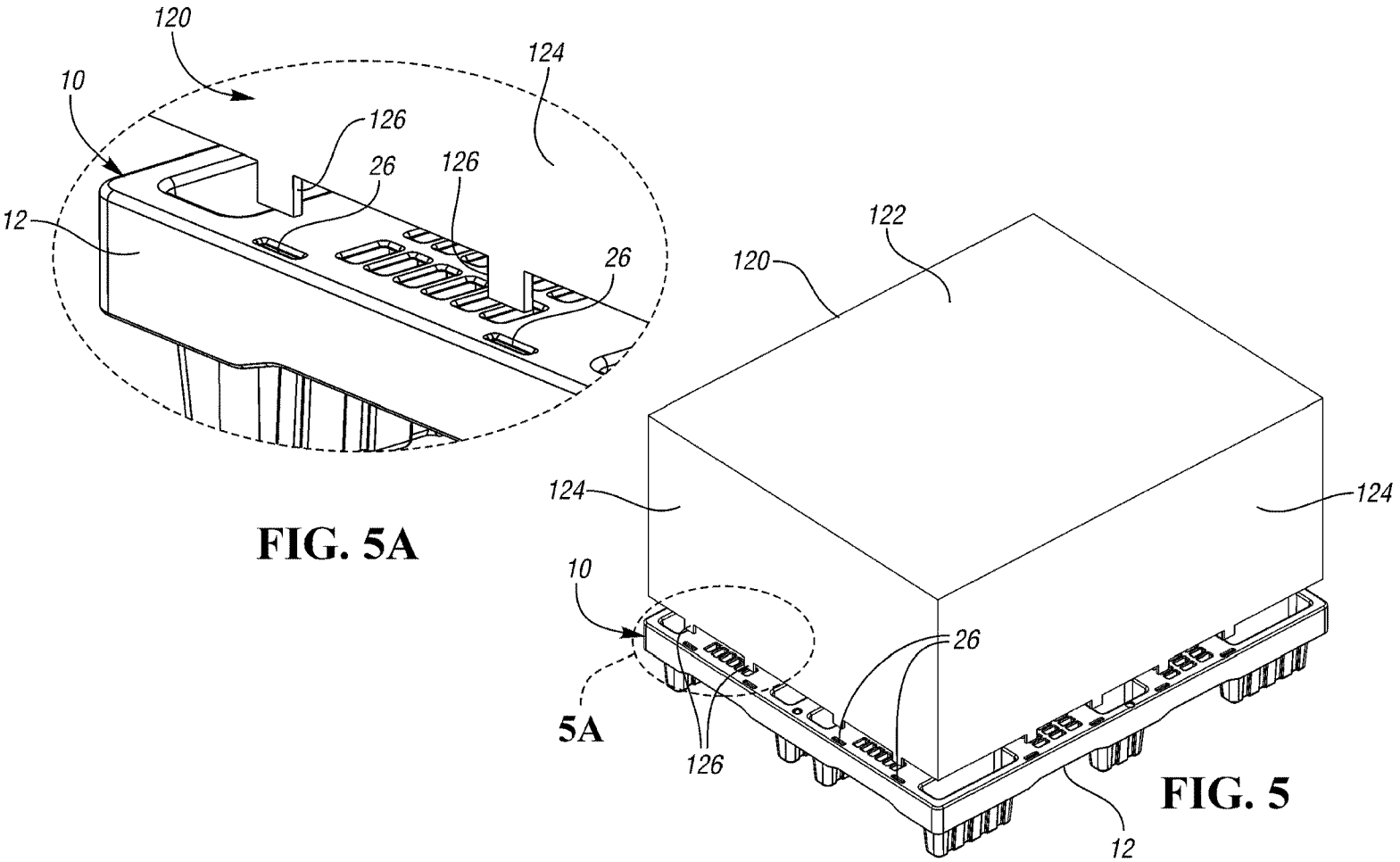
FIG. 5 shows the pallet with a covering being connected thereto.
FIG. 5A is an enlarged view of a portion of FIG. 5.

As shown in FIG. 5, a display and/or cover 120 having an upper wall 122 and four side walls 124 extending downward from the upper wall 122 may be placed on the pallet 10 over the goods (not shown) loaded on the pallet 10. The cover 120 can be used for protection of the goods during shipping and provides large areas for labelling, communication and/or advertisement. Alternatively, a display that does not completely cover the goods can be used for labelling, communication and/or advertisement. As shown, each side wall 124 includes a plurality of tabs 126 that are receivable in the slots 26 about the periphery of the deck 12. This is shown more clearly in the detail view in FIG. 5A.

Figure 7:
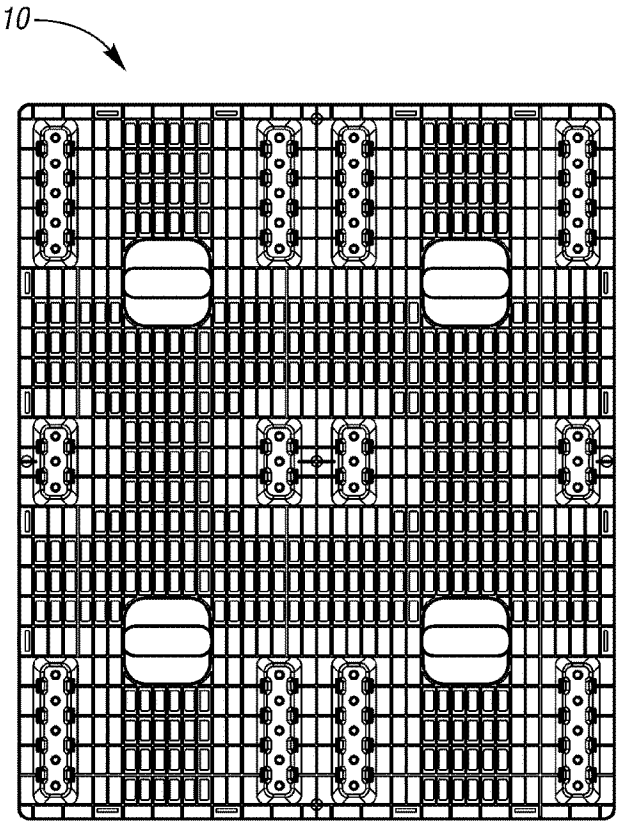
FIG. 7 is a bottom view of the pallet.

FIG. 6 is a top view of the pallet 10. FIG. 7 is a bottom view of the pallet 10.

Figure 8:
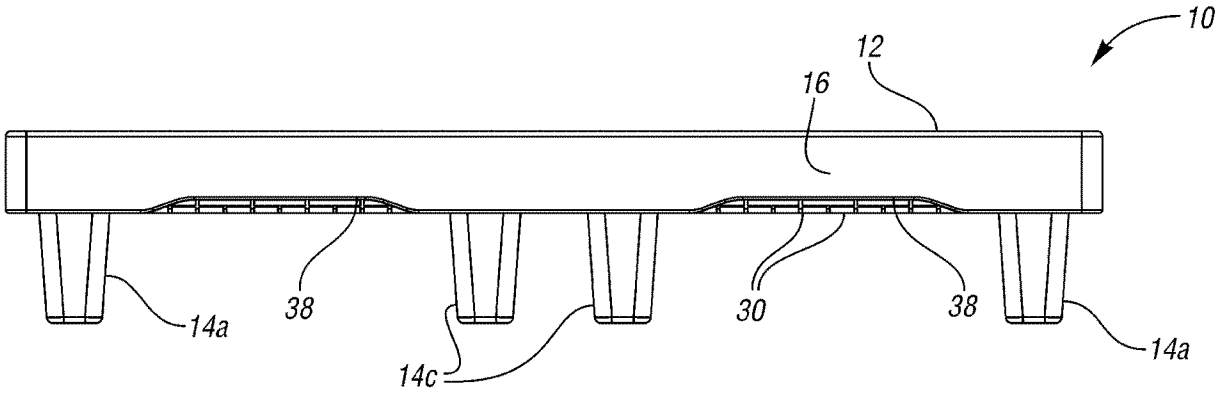
FIG. 8 is an end view of the pallet.
Figure 9:
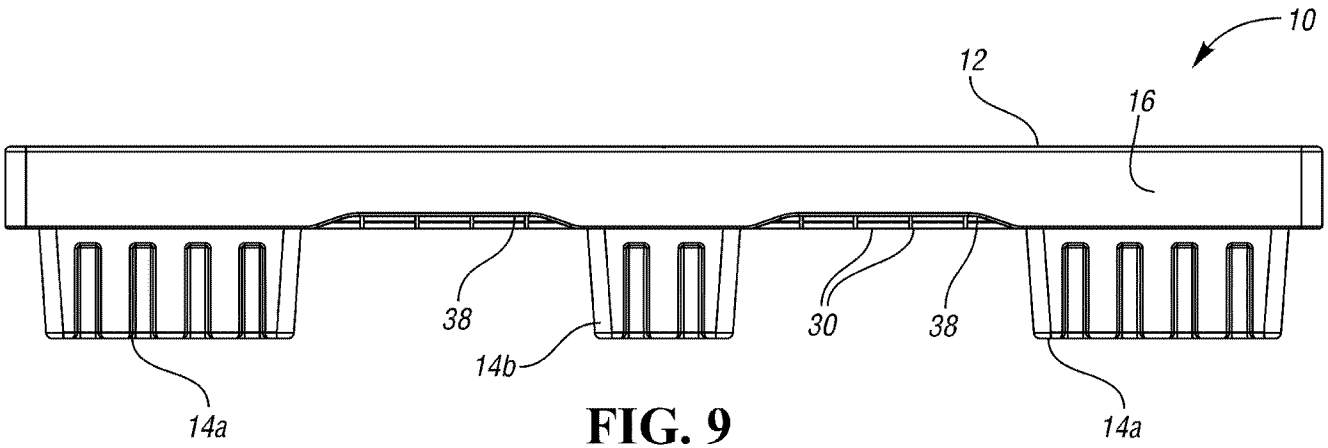
FIG. 9 is a side view of the pallet.

FIG. 8 is an end view of the pallet 10. FIG. 9 is a side view of the pallet 10. As can be seen in FIGS. 8 and 9, the fork tine openings between the feet 14 include a chamfer 38 at the leading edge of the deck 12. The chamfer 38 is formed from tapered ribs 30 and short, elongated recesses in the bottom edge of the lip 16. Also, the lip 16 is large and extend downward a substantial percentage of the height of the pallet 10, in this example, approximately 40%. This provides large side surfaces on the lip 16 on all four sides of the pallet 10 that can be used for customer interaction, branding, colors, graphics, etc.

Figure 10:
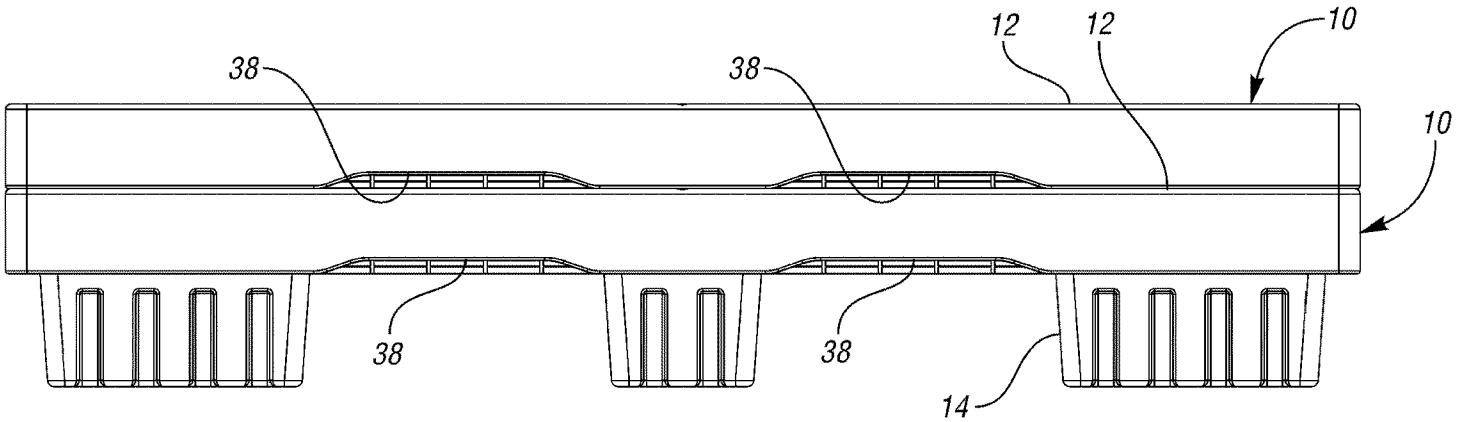
FIG. 10 is a side view of the pallet nested with an identical pallet.

FIG. 10 shows a pair of nested pallets 10, with the feet 14 of the upper pallet 10 received substantially in the openings 18 through the deck 12 of the lower pallet 10 and in the feet 14 of the lower pallet 10. Referring to FIG. 10, the chamfers 38 facilitate splitting a stack of nested, empty pallets 10 with fork tines so that the upper pallet 10 could be removed from the lower pallet 10.

Figure 11:
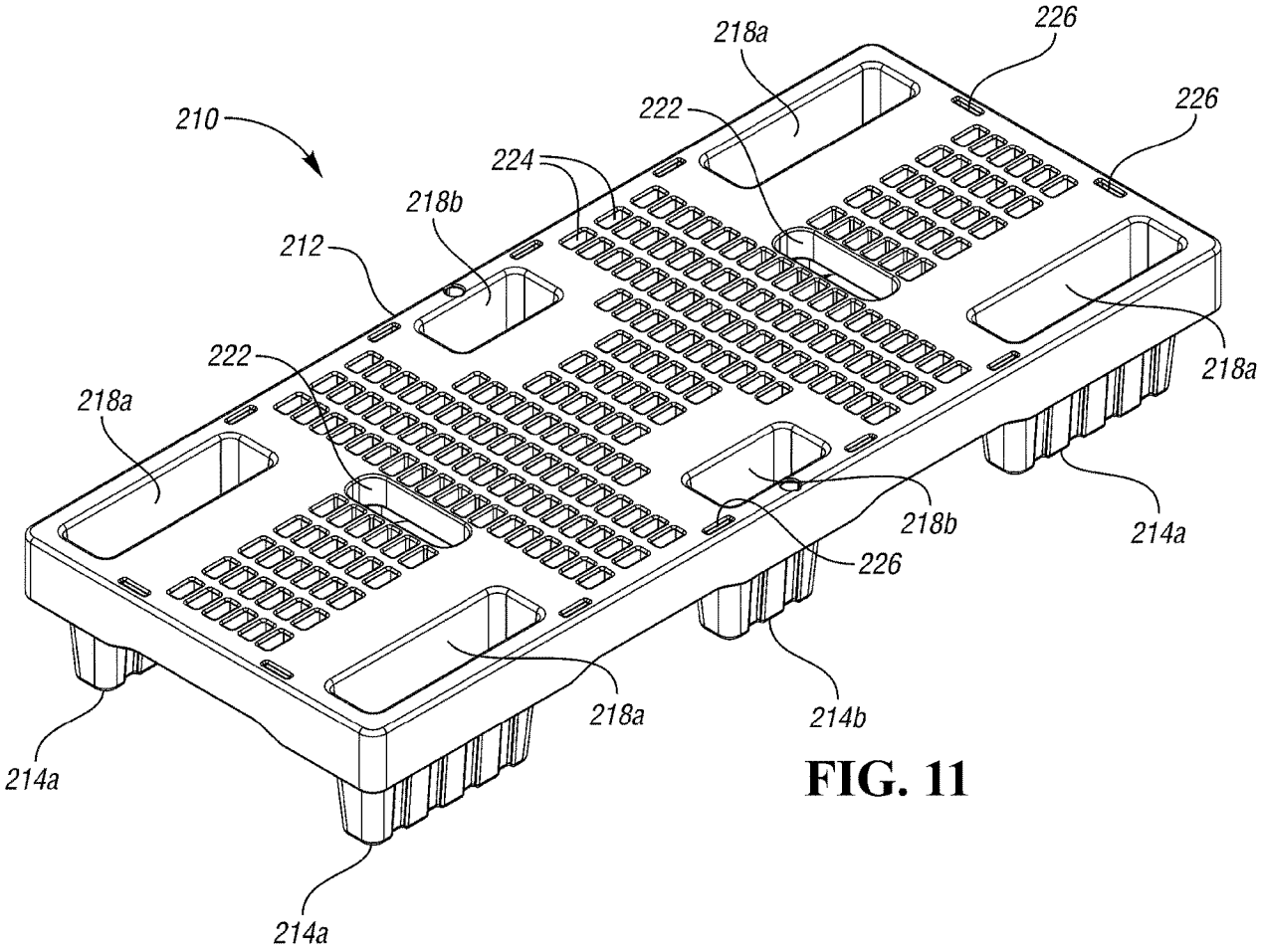
FIG. 11 is a perspective view of a half pallet.

FIG. 11 shows a half-size pallet 210 version of the full-size pallet 10 of FIG. 1. Except as otherwise described or shown in the Figures, it is half of the full-size pallet 10 of FIG. 1. The deck 212 of the pallet 210 is half the size of the pallet 10 of FIG. 1. Thus, the pallet 210 includes two outer feet 214*a* at each end of the pallet 210 and two inner feet 214*b* between the outer feet 214*a*. The outer feet 214*a* are identical (or at least complementary) to the outer feet 14*a* of the pallet 10 of FIG. 1. The inner feet 214*b* are identical (or at least complementary) to the inner feet 14*b* of the pallet 10 of FIG. 1.

The deck 212 includes openings 218*a-b* aligned with the feet 214*a-b*. The deck 212 includes handle openings 222 (identical to handle openings 22 of the pallet 10) and smaller openings 224. The deck 212 includes the slots or openings 226 about the periphery of the deck 212 for receiving a cover or display (similar to FIGS. 5 and 5A, but half-size).

Figure 12:
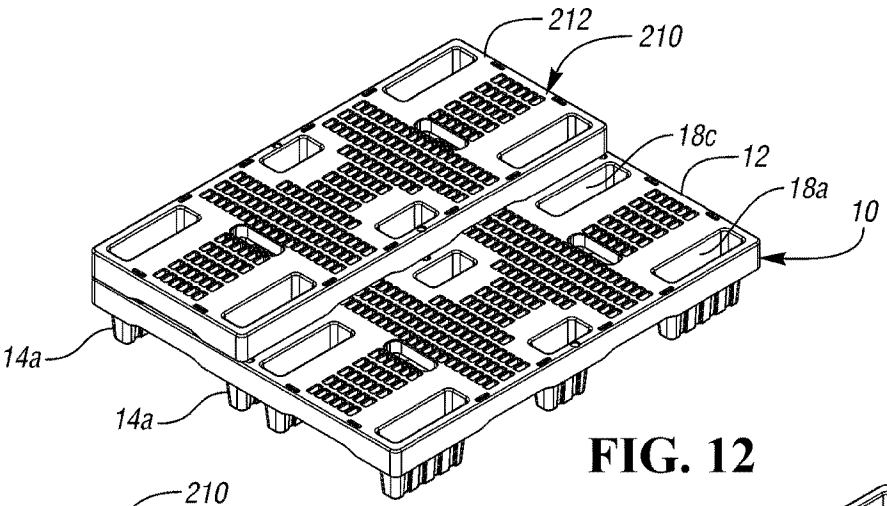
FIG. 12 shows the half pallet of FIG. 11 nested with the pallet of FIG. 1.

As shown in FIG. 12, the half-size pallet 210 can be nested with the pallet 10. The outer feet 210*a* of the half-size pallet 210 are received in the openings 18*a* and outer feet 14*a* on one half of the full-size pallet 10. Similarly, the inner feet 214*b* are received in the openings 18*b* and inner feet 14*b* on that half of the full-size pallet 10.

Figure 14:
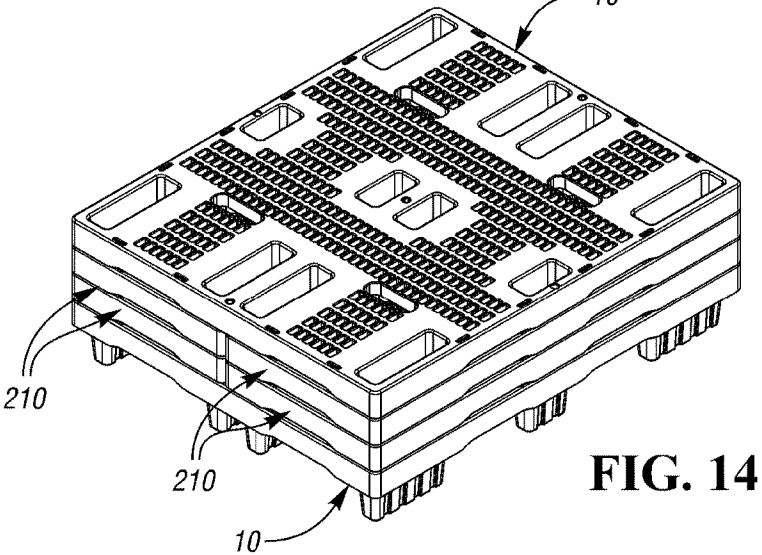
FIG. 14 shows several half pallets nested with two of the pallets of FIG. 1.
Figure 13:
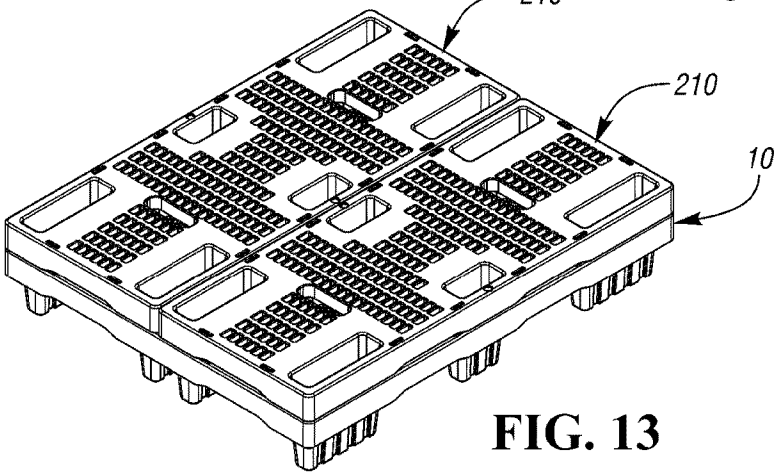
FIG. 13 shows two of the half pallets of FIG. 11 nested with the pallet of FIG. 1.

As shown in FIG. 13, two of the half-size pallets 210 can be nested on the full-size pallet 10. As shown in FIG. 14, a full-size pallet 10 can also be nested on two half-size pallets 210. Each of the pallets 10, 210 is molded as a single piece of suitable plastic.

Figure 15:
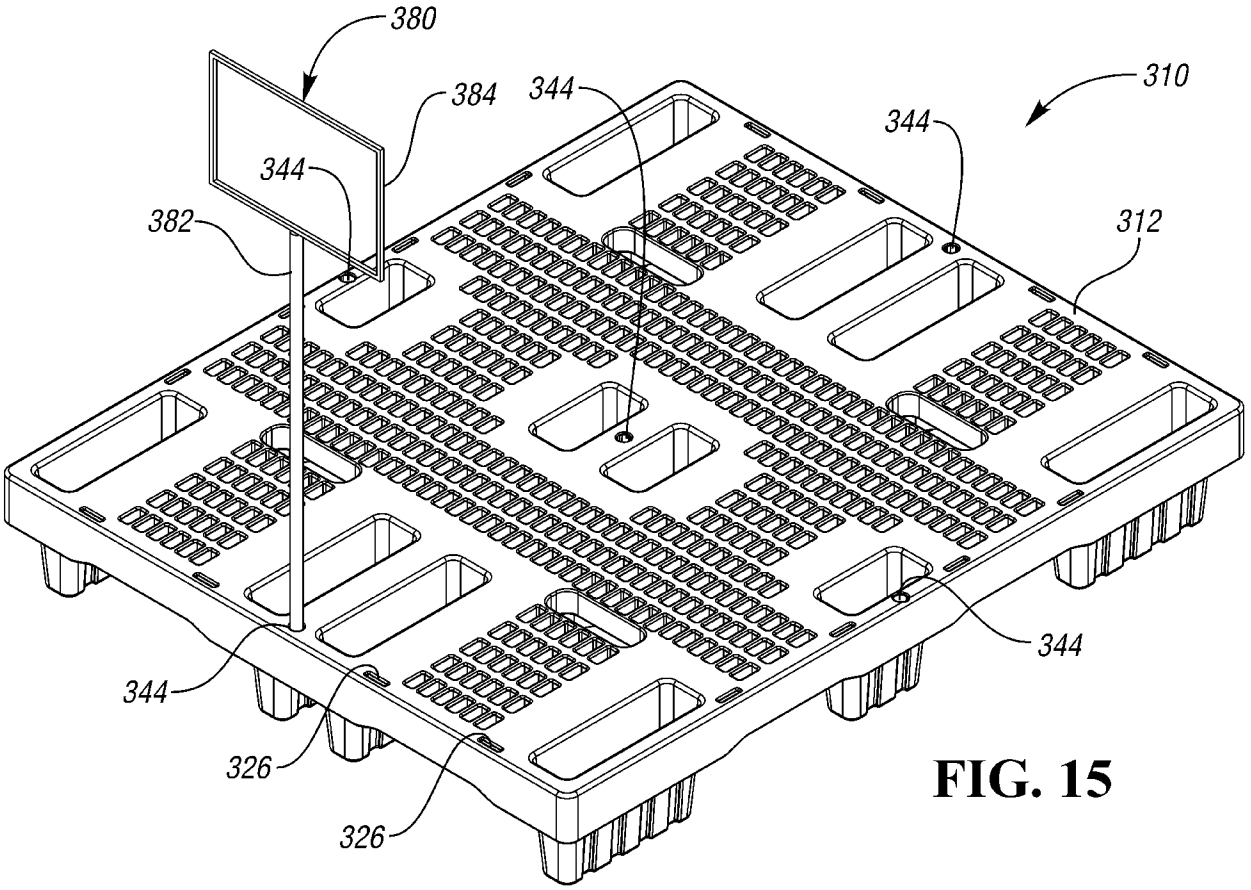
FIG. 15 shows an alternate pallet with an optional sign mounted thereon.

FIG. 15 shows an alternate pallet 310 with an optional sign 380. The pallet 310 is identical to the pallet 10 of FIG. 1 except it also has a plurality of apertures 344. In this example, apertures 344 are formed at the center of each of the side edges and end edges of the deck 312, and in the very center of the deck 312. The apertures 344 may be in addition to, and distinctive from, the slots 326 around the perimeter for receiving the cover. The optional sign 380 includes a signpost 382 mounted to a frame 384. The frame 384 can removably hold a card with information indicating the contents of containers (not shown) on the pallet 310, such as the brand, price, etc. The signpost 382 is removably inserted into one of the apertures 344. Similar apertures could be formed in the half pallet 210.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A nestable pallet comprising:

a deck having an upper support surface, opposed side edges and opposed end edges, the deck including a handle opening having at least one handle wall adjacent the handle opening, a plurality of ribs extending upward from the at least one handle wall; and a plurality of feet extending downward from the deck to a lowermost surface of the pallet, wherein the feet are hollow and elongated in a direction parallel to the side edges of the deck, wherein the handle wall is in a plane between a plane of the lowermost surface of the pallet and a plane of the upper support surface, the deck including openings therethrough that lead into the feet for receiving the feet of an identical nestable pallet nested thereon.

2. The nestable pallet of claim 1 wherein the side edges are longer than the end edges, the plurality of feet including eight outer feet, wherein four of the eight outer feet are adjacent a first end edge of the deck and four of the eight outer feet are adjacent a second end edge of the deck, opposite the first end edge, the plurality of feet further including four inner feet centered between the end edges of the deck.

3. The nestable pallet of claim 2 wherein the deck includes an upper panel portion having a plurality of integrally molded ribs extending downwardly therefrom.

4. The nestable pallet of claim 3 wherein the outer feet are elongated to have a length at least three times their width.

5. The nestable pallet of claim 4 wherein side walls of the plurality of feet are corrugated.

6. The nestable pallet of claim 2 wherein the eight outer feet are elongated to have a length at least three times their width.

7. The nestable pallet of claim 6 wherein the four outer feet at each end edge include two corner feet at corners of the deck and two middle feet between the corner feet, wherein the two middle feet are closer to one another than to the corner feet.

8. The nestable pallet of claim 2 further including a plurality of slots about a perimeter of an upper surface of the deck.

9. The nestable pallet of claim 8 further including a display received in at last some of the plurality of slots.

10. The nestable pallet of claim 2 wherein the deck includes an aperture formed therein, wherein a sign including a signpost is mounted to the pallet, with the signpost received in the aperture.

11. The nestable pallet of claim 10 wherein the aperture is one of a plurality of apertures disposed at a center of each of the side edges and end edges of the deck and at a center of the deck, wherein the signpost is receivable in all of the apertures.

12. The nestable pallet of claim 1 wherein the deck includes a plurality of support ribs reinforcing the upper support surface, wherein the handle wall is recessed from bottom edges of the support ribs, such that the plane in which the handle is located is between the plane of the upper support surface and a plane of the bottom edges of the support ribs.

13. The nestable pallet of claim 1 wherein the at least one handle wall is generally parallel to the deck.

14. The nestable pallet of claim 13 wherein upper edges of the plurality of ribs are flush with an upper surface of the deck.

15. In combination:

a nestable pallet including a deck having opposed side edges and opposed end edges, and a plurality of feet extending downward from the deck, the plurality of feet including four outer feet adjacent each end edge of the deck and four inner feet centered between the end edges of the deck, wherein the plurality of feet are hollow and elongated in a direction parallel to the side edges of the deck, the deck including openings therethrough that lead into the feet for receiving the feet of an identical nestable pallet nested thereon; and a half pallet having a half deck and a plurality of feet extending downward from the half deck and into half of the plurality of feet of the nestable pallet.

16. A nestable pallet comprising:

a deck having opposed side edges and opposed end edges, the deck including an upper planar portion and a plurality of reinforcement ribs extending downwardly from the upper planar portion, the deck further including a handle opening having at least one handle wall adjacent the handle opening, a plurality of ribs extending upward from the handle wall; and a plurality of feet extending downward from the deck below the at least one handle wall, wherein the feet are hollow, the deck including openings therethrough that lead into the feet for receiving the feet of an identical nestable pallet nested thereon.

17. The nestable pallet of claim 16 wherein the at least one handle wall is above bottom edges of the reinforcement ribs.

18. The nestable pallet of claim 17 wherein the deck includes a plurality of openings formed through the upper planar portion between the ribs extending upward from the handle wall.

19. The nestable pallet of claim 18 wherein the handle wall is a first handle wall and wherein the deck further includes a second handle wall adjacent the handle opening, such that the handle opening is between the first handle wall and the second handle wall, the second handle wall having a plurality of ribs extending upwardly therefrom.

20. The nestable pallet of claim 16 wherein the handle wall is generally parallel to the deck.

21. The nestable pallet of claim 16 wherein the side edges of the deck are longer than the end edges of the deck, wherein the side edges meet the end edges at corners of the deck, the plurality of feet including four corner feet adjacent the corners of the deck, each of the end edges of the deck further including a pair of spaced-apart center feet adjacent thereto, wherein the pair of center feet are closer to one another than to the corner feet adjacent the respective end edge, wherein the plurality of corner feet and the center feet are elongated to have a length at least three times their width, the plurality of feet further including four inner feet spaced between the end edges, wherein one of the inner feet is adjacent each side edge between the corner feet, and wherein two of the inner feet are centered between the end edges and between the side edges, wherein the plurality of feet are elongated in a direction parallel to the side edges of the deck.

22. The nestable pallet of claim 21 wherein the deck includes an upper panel portion having a plurality of integrally molded ribs extending downwardly therefrom.

23. In combination:

a nestable pallet including a deck having opposed side edges and opposed end edges, and a plurality of feet extending downward from the deck, wherein the feet are hollow and elongated in a direction parallel to the side edges of the deck, the deck including openings therethrough that lead into the feet for receiving the feet of an identical nestable pallet nested thereon; and a pair of half pallets each having a half deck and a plurality of feet extending downward from the half deck;

wherein the plurality of feet of the half pallets are each receivable into half of the plurality of feet of the nestable pallet, such that both half pallets can be nested in the nestable pallet simultaneously side-by-side.

24. The combination of claim 23 wherein the deck of the nestable pallet includes an upper panel portion having a plurality of integrally molded ribs extending downwardly therefrom.

25. The combination of claim 24 wherein the plurality of feet of the nestable pallet include a plurality of outer feet adjacent each side edge of the deck of the nestable pallet, wherein the outer feet are elongated to have a length at least three times their width, and wherein side walls of the plurality of feet of the nestable pallet are corrugated.

26. The combination of claim 25 wherein the outer feet adjacent each side edge of the deck of the nestable pallet include two corner feet at corners of the deck and two middle feet between the corner feet, wherein the two middle feet are closer to one another than to the corner feet.

* * * * *